US007291020B2

(12) United States Patent
Soh

(10) Patent No.: US 7,291,020 B2
(45) Date of Patent: Nov. 6, 2007

(54) ELECTRICAL CONNECTOR

(75) Inventor: Lip Teck Soh, Singapore (SG)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/523,595

(22) PCT Filed: Jul. 31, 2003

(86) PCT No.: PCT/SG03/00185

§ 371 (c)(1),
(2), (4) Date: Nov. 14, 2005

(87) PCT Pub. No.: WO2004/015821

PCT Pub. Date: Feb. 19, 2004

(65) Prior Publication Data

US 2006/0183357 A1 Aug. 17, 2006

(30) Foreign Application Priority Data

Aug. 12, 2002 (SG) ..... 200204865-0

(51) Int. Cl.
*H01R 12/00* (2006.01)

(52) U.S. Cl. ..... 439/66; 439/567

(58) Field of Classification Search ..... 439/66, 439/74, 567

See application file for complete search history.

(56) References Cited

U.S. PATENT DOCUMENTS 5,080,611 A 1/1992 Hypes ..... 439/567
5,257,948 A * 11/1993 Peterson ..... 439/571
5,966,267 A * 10/1999 Hooley et al. ..... 360/97.01
5,975,914 A 11/1999 Uchida ..... 439/66
6,764,315 B2 * 7/2004 Ng et al. ..... 439/66
6,855,004 B2 * 2/2005 Soh ..... 439/509
D528,985 S * 9/2006 Peng ..... D13/147
2003/0124879 A1 * 7/2003 Ng et al. ..... 439/66
2003/0124892 A1 * 7/2003 Soh ..... 439/181

* cited by examiner

*Primary Examiner*—James R. Harvey
(74) *Attorney, Agent, or Firm*—Harrington & Smith, PC

(57) ABSTRACT

An electrical connector to interpose between a first electrical device and a second electrical device each having a plurality of conductive pads to electrically, the electrical connector comprising a housing carrying a plurality of conductive elements, each conductive element including a first contact region for engagement with a conductive pad of the first electrical device and a second contact region for engagement with a conductive pad of the second electrical device. The conductive elements are carried by the housing to present at least the first contact region for compressive engagement with the surface of the first electrical device. The housing presents a latching means to engage with the first electrical device to retain the first electrical device with the housing in a direction which extends parallel to the direction of compressive engagement to thereby hold the plurality of conductive pads of the first electrical device in physical contact with respective the first regions of the conductive elements.

37 Claims, 4 Drawing Sheets

ELECTRICAL CONNECTOR

BACKGROUND

Electrical connectors for connecting between two devices such as for example printed circuit boards are well known. In modern applications, electrical connection between two electrical devices may need to be made wherein a high density of individual electrical leads of a printed circuit board require connection with another electrical device. Connectors which make the connection between the two devices for such applications are often referred to as high density connectors. This is because the individual conductive elements of the connector need to correspond with closely spaced electrical leads of a printed circuit board. An electrical connector may be securely mounted to one electrical device and subsequently engaged to another electrical device such as a printed circuit board by the use of a fastening screw or screws. For example it can be seen in U.S. Pat. No. 5,966,267 that an electrical connector which carries a plurality of conductive elements is able to make electrical contact with an electrical device which is screwed to the connector. During the assembly of such an arrangement, the printed circuit board is pressed against the contacts of the electrical connector by tightening a screw which extends through the printed circuit board and into the body of the connector.

As the conductive elements of this type of connector are compression conductive elements which are able to be deflected upon contact with a printed circuit board, it is possible to over tighten the screw and damage the connector. A warping of the printed circuit board may be caused by high compression forces when the printed circuit board is tightened down. The printed circuit board is unable to take the load and therefore warps under it. The degree of warping of the printed circuit board at the area of contact with the electrical connector will also be influenced by such factors as the thickness of the printed circuit board, the number and position of fastening elements and any additional support that may be provided. One way that the problem may be overcome is by the provision of a threaded insert provided in the body of the connector with which a screw can engage for tightening. The insert may provide a limit to the degree of compression that can be provided by a screw. However the provision of a threaded insert may not always be feasible as for example the body of the compression connector may have size constraints. A further disadvantage with the provision of a threaded tightening screw is that the process of engagement of the printed circuit board with the electrical connector will require an assembly step which involves the use of a tightening device such as a screw driver. This is a manufacturing step which can add to the time of assembly and the complexity of assembly equipment. The rotational engagement of the screw can also induce a torque on the connector and/or the circuit broad which may lead to undesirable effects.

Accordingly it is an object of the present invention to provide an electrical connector which will improve the ease of assembly and avoid the above mentioned problems or at least provide the public with a useful choice.

BRIEF DESCRIPTION OF THE INVENTION

In a first aspect the present invention consists in an electrical connector to interpose between opposing surfaces of a first electrical device having a plurality of conductive pads and a second electrical device having a plurality of conductive pads to electrically connect each pad on the surface of said first electrical device with a respective pad on the surface of said second electrical device, the electrical connector comprising;

a housing carrying a plurality of conductive elements, each conductive element including a first contact region for engagement with a conductive pad of the surface of said first electrical device and a second contact region for engagement with a conductive pad of the surface of said second electrical device, said conductive elements carried by said housing to present at least said first contact region for compressive engagement with the surface of said first electrical device, said housing presenting a latching means to engage with said first electrical device to retain said first electrical device with said housing in a direction which extends parallel to the direction of compressive engagement to thereby hold said plurality of conductive pads of said first electrical device in physical contact with respective said first contact regions of said conductive elements.

In a second aspect the present invention consists in an electrical assembly including and electrical connector interposing between opposing surfaces of a first electrical device having a plurality of conductive pads and a second electrical device having a plurality of conductive pads, electrically connecting each pad on the surface of said first electrical device with a respective pad on the surface of said second electrical device, wherein the electrical connector comprises;

a housing carrying a plurality of conductive elements, each conductive element including a first contact region engaged with a conductive pad of the surface of said first electrical device and a second contact region engaged with a conductive pad of the surface of said second electrical device, said conductive elements carried by said housing to present at least said first contact region in a compressive engagement with the surface of said first electrical device, said housing presenting a latching means engaged with said first electrical device to retain said first electrical device with said housing at least in a direction which extends parallel to the direction of compressive engagement to thereby hold said plurality of conductive pads of said first electrical device in physical contact with respective said first contact regions of said conductive elements.

Preferably said latching means is a snap fit latching means. Preferably said latching means is an umbrella like expansion snap fit latching means.

Preferably said latching means includes at least one pair of latching regions provided by at least one leg projecting from said housing, at least on latching region including an edge or surface the normal to which extends in a direction parallel to the direction of compressive engagement, the edge or surface engagable to a complementary edge or surface of said first electrical device the normal to which extends in a direction opposite to said first mentioned normal to thereby retain said first electrical device with said housing wherein each latching region is deflectable towards each other in a resilient manner and along a path which extends in a direction lateral to the direction of compressive engagement and thereby allows a snap-fit engagement with said first electrical device to occur.

Preferably said latching means includes at least one pair of latching regions provided by at least one leg projecting from said housing, at least on latching region including an edge or surface the normal to which extends in a direction parallel to the direction of compressive engagement, the edge or surface engagable to a complementary edge or surface of said first electrical device the normal to which extends in a direction opposite to said first mentioned normal to thereby retain said first electrical device with said housing wherein each latching region is deflectable away from each other in a resilient manner and along a path winch extends in a direction lateral to the direction of compressive engagement and thereby allows a snap-fit engagement with said first electrical device to occur.

Preferably said latching regions are provided in the form of a lip of said at least one leg.

Preferably a latching regions is provided by a respective said leg.

Preferably at least one pair of legs are provided each leg including one latching region.

Preferably each leg of said pair is resiliently biased towards a condition wherein said pair of legs are mutually cooperative to encourage said edge or surface of each latching region to remain in contact with a respective complementary edge or surface of said first electrical device.

Preferably said lip is defined by the profile of said leg.

Preferably said first electrical device with which said electrical connector is to engage, is a printed circuit board.

Preferably said latching means extends from said housing to pass through an opening in said printed circuit board and wherein said latching means presents a lip to engage with the major surface of said printed circuit board opposite to said first mentioned surface.

Preferably said lip is positioned relative to said housing so that when said printed circuit board is held to said housing by said latching means said printed circuit board is pressed against said first contact regions with a force which is within the specifications for desired characteristic of physical contact.

Preferably said housing is of a generally elongate body which includes an upper surface and an opposite facing lower surface both substantially parallel to the elongate direction of said body an wherein said latching means extends from said housing at the upper surface.

Preferably the latching means comprises of a leg upstanding form the housing in a direction parallel to the direction of said compressive engagement and having a section there along which is of an increased width in a direction lateral to said compressive engagement direction which is to engage with an aperture of said first electrical device in an interference fit engagement manner.

Preferably said section is deformable relative to said leg.

Preferably said section includes a barbed edge which is to pressed into a surface of said first electrical device at said aperture Preferably the latching means comprises of a leg upstanding form the housing in a direction parallel to the direction of said compressive engagement and having a section there along which is of an increased width in a direction lateral to said compressive engagement direction which is engaged at an aperture of said first electrical device in an interference fit engagement manner.

Preferably said section is deformable relative to said leg.

Preferably said section includes a barbed edge which is pressed into a surface of said first electrical device at said aperture.

Preferably said section is at a distance along said leg such that it securely engages said first electrical device and simultaneously holds said surface thereof in compressive engagement with the first contact regions of said conductive elements.

Preferably said latching means is of a sheet metal material and includes a housing located region which is engaged to the housing within a cavity thereof.

Preferably said housing holds two arrays of conductive elements each array extending in a longitudinal direction and disposed along respective sides of said housing, said cavity of said housing retaining said housing located region of latching means extending in a longitudinal direction and intermediate of said two arrays.

This invention may also be said broadly to consist in the pats, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth. A preferred form of the invention will now be described with reference to the accompanying drawings.

DETAILED DESCRIPTION OF THE INVENTION

Figure 1:
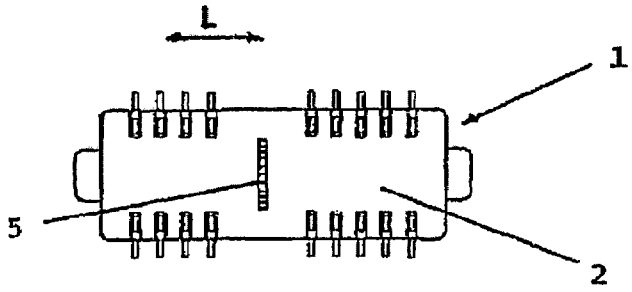
FIG. 1 is a plan view of a preferred form of an electrical connector of the present invention.

With reference to FIG. 1 there is shown an electrical connector 1 which includes a housing 2 which holds a plurality of conductive elements 15. The housing 2 holds the conductive elements in a manner so that the contact regions 7 of the conductive elements are able to move relative to the housing. Such contact regions 7 are able to be moved to compress the respective conductive elements and as a result provide a biasing force of the contact regions 7 in the direction from which the compression force is directed. The housing holds a plurality of conductive elements in an appropriate array which corresponds with electrical leads, pads or traces (herein after referred to as "pads") which are provided by two electrical devices. The electrical connector 1 presents each conductive element so that each first contact region 7 can engage with an electrical pad of a first electrical device and a second contact regions 6 of the conductive element can engage with an electrical pad of a second electrical device. An electrical connection between the pads of the first and second electrical devices is then established.

The pads axe provided on a surface of the first electrical device. The surfaces of the two electrical devices are preferably facing each other and between which the electrical connector of the present invention can be interposed.

With reference to FIG. 1, the housing of the electrical connector is preferably of an elongate (in the L direction) shape. The housing includes a lower surface 3 and an upper surface 4 and in a cross section transverse to the elongate direction L, the housing is substantially square or rectangular in shape. When viewed in plan, it can be seen with reference to FIG. 1 that the outline of the housing is also substantially rectangular in shape and the housing includes perimeter side walls and end walls extending between the lower and uppers surfaces.

The conductive elements 15 are carried by the housing and may at some point be rigidly fixed to the housing but yet present the first contact regions 7 in a displaceable manner thereto. The second contact regions 6 may also be displaceable relative to the housing but this need not be necessarily so. The first contact regions 6 may be provided for a soldered connection to a second electrical device which may not be (or be solely) a compression connection. The second contact regions 7 are displaceable relative to the housing 2 when a first electrical device is advanced for engagement with the electrical connector in direction C. The first contact regions 7 will displace in the direction C on contact with the pads of the surface of the first electrical device. A movement transverse to the direction C may also occur but this need not be necessarily so. The movement in direction C will thereafter bias the first contact regions 7 towards the surface of the first electrical device thereby making electrical contact with the pads.

Figure 2:
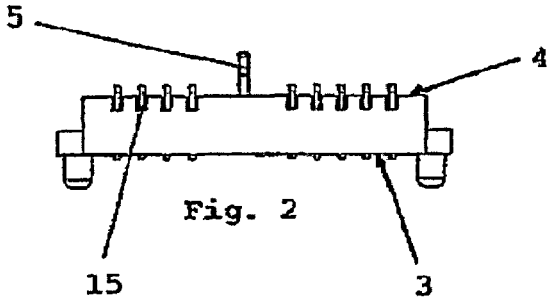
FIG. 2 is a front view of the FIG. 1.

A latching means 5 is provided to extend from the housing 2 of the electrical connector. As can be seen with reference to FIGS. 2, 3 and 4, the latching means preferably extend from the upper surface 4 of the housing. The direction of extension is such so as to provide a portion of the latching means 5 which engages onto a locking surface of the first electrical device and when the first electrical device is in an appropriate relationship for contact with the first contact regions 7. It will hold the electrical device relative to the housing and thereby prevent the electrical device from moving in a direction opposite to the direction C.

Figure 3:
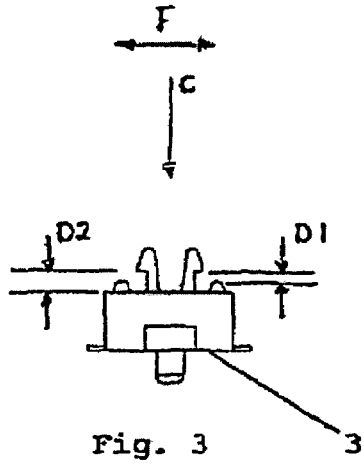
FIG. 3 is an end view of FIG. 1.
Figure 4:
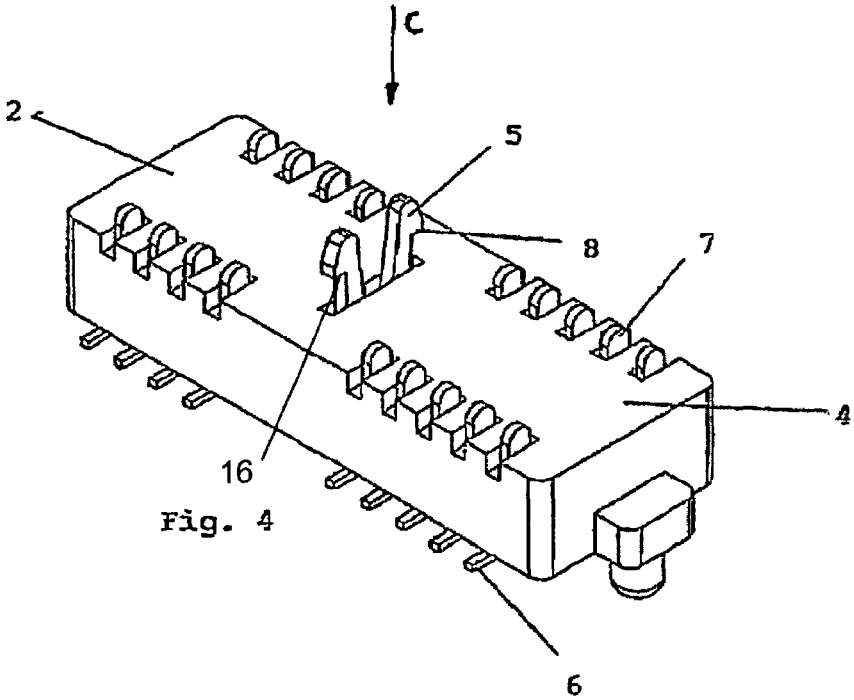
FIG. 4 is a perspective view of FIG. 1.
Figure 5:
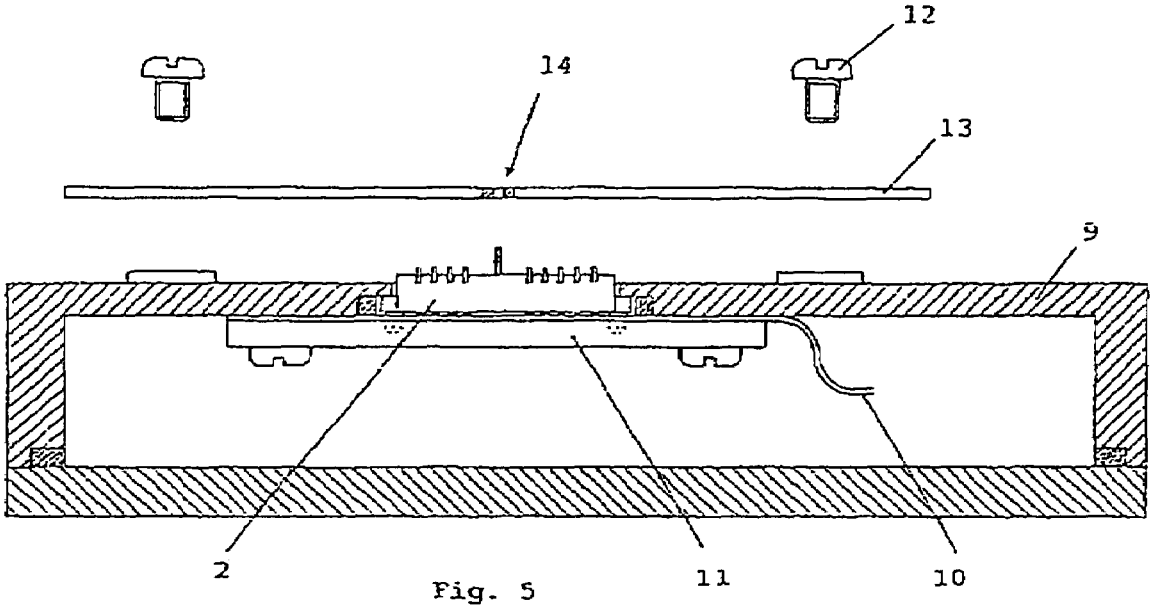
FIG. 5 is side view of the electrical connector of the present invention engaged with a second electrical device and showing a first electrical device ready to be engaged with the electrical connector.
Figure 6:
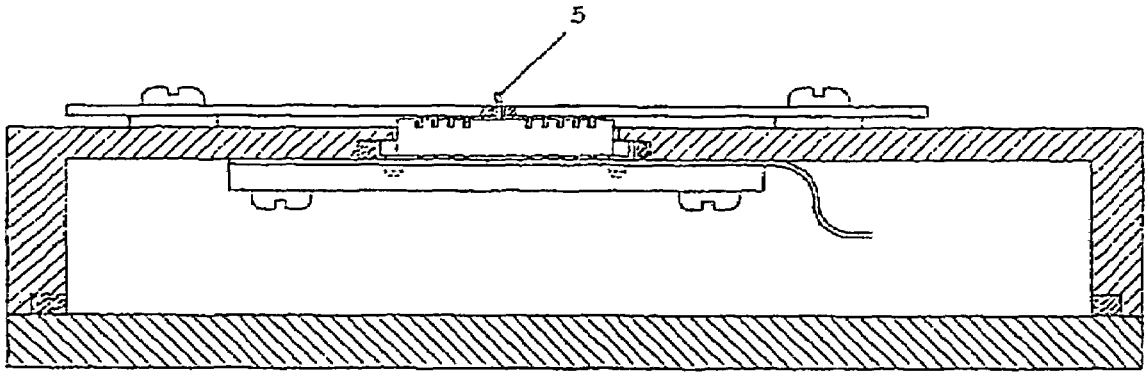
FIG. 6 illustrates the view of FIG. 5 and wherein the first electrical device is engaged with the connector.

The latching means is able to extend through an opening 14 of the first electrical device as for example shown in FIGS. 5 and 6. The opening is of a size such that when the first electrical device is engaged with the electrical connector, the latching portions of the latching means become engaged with the first electrical device to thereby hold the electrical device relative to the housing. The latching portion 8 of the latching means 5 is preferably a lip 16. Such a lip 16 includes an edge or surface which protects back towards the housing. The lip 16 can engage with an opposite facing surface of the first electrical device and when mutually cooperating with each other hold the electrical device relative to the housing and prevent the electrical device from moving in a direction opposite to direction C relative to the connector. With reference to FIG. 4, it can be seen that the latching means preferably includes two legs, each leg providing such a latching region 8. The legs at the latching region substantially define an "L" shaped profile as for example shown in FIG. 3. With the provision of two legs each providing a latching region 8, the latching means can for example extend through an opening 14 of the first electrical device and be secured at two different locations on an upwardly facing surface of the first electrical device. The legs as in the form shown in FIG. 4, are preferably movable relative to each other in direction F. This direction F is shown in FIG. 4 to be transverse to direction L but may instead be parallel thereto. The legs can be moved towards each other sufficiently to allow for the outer extreme surfaces (when viewed in the end view as shown in FIG. 3) to extend through the aperture 14 of the first electrical device. The effective overall width of the latching means is hence able to be reduced as it is inserted through an appropriate shape opening. Once the latching regions 8 have passed through the opening or aperture 14, the biasing force will move the two legs of the latching means outwardly and away from each other thereby simultaneously engaging the latching regions 8 with the upwardly facing surface of the first electrical device. The latching means also provides restrain to movement of the first electrical device relative to the housing in the direction transverse to the compressive engagement direction as a result of the vertical portions of the "L" shaped legs engaging with the side walls of the aperture.

The latching means in the most preferred form is a pair of legs however in other forms, the latching means may consist of more than one pair of legs. Indeed more than one latching means may be provided to extend from the housing of the connector. Several latching means may be provided one to have legs deflectable in direction L and another to have deflectable legs in direction F.

In the most preferred form the latching means extends from the housing substantially centrally both in the longitudinal direction and in the direction transverse to the longitudinal direction. However two (or more) latching means may be provided each positioned towards ends of the housing.

The most preferred form of the first electrical device for which the connector of the present invention is designed is a printed circuit board. The printed circuit board will present on one of the surfaces a series of electrical pads which have been generated on that surface of the printed circuit board. The printed circuit board is normally of a thin material substrate and the latching means of the connector of the present invention is able to extend through the substrate and locate its latching regions 8 onto the surface of the substrate opposite to that surface where the electrical pads for connection with the connector are provided. The distance in direction C between the latching regions 8 and the first contact regions 7 of the conductive elements is of a distance which has been matched to the thickness of the substrate of the printed circuit board 13. The thickness of the circuit board is greater than distance D1 which is the distance in direction C between the latching regions 8 and the uppermost point of the contact regions 7 when the contact regions are in a non deflected state. The thickness of the substrate is no greater than the distance D2 which is the distance in direction C between the latching regions 8 and the point where the upper surface of the contact regions 7 will be positioned at a limit of its deflection. Such distance D2 may be to the upper surface 4 of the housing 2 when the upper contact regions 7 are provided to extend upwardly from the upper surface 4 of the housing.

With reference to FIG. 5, it can be seen that the connector 2 is engaged with a casing 9. It is clamped against a casing by means of a backing plate 11 which provides support to a second electrical device 10 such as a flex. The backing plate 11 will hold the second electrical device to the casting 9.

The first electrical device 13 such as the printed circuit board is also able to be mounted to the casing 9. Such mounting may be secured by the use of a machine screw 12. The fastening means provided by the form of machine screws 12 will hold the printed circuit board to the housing via its collection to the casing 9. The latching means 5 provides fastening of the printed circuit board with the connector and indeed provides such fastening much more proximate to the contact point between the conductive elements 15 and the pads of the printed circuit board. Such more proximate support will reduce the degree of deflection of the printed circuit board in the region of the electrical connector and hence ensure for a reliable connection being established.

The latch itself may be unitary with the housing and may be molded of the same material as the housing (e.g. plastic). Alternatively and in the more preferred form, the latch is made from a metal and is for example stamped from a sheet material and subsequently installed with the housing. The housing may be molded to provide a cavity for receiving the latching means and present it to the extend from the housing for use.

Whilst in the most preferred form the latch has been described as consisting of two legs, each having a lip 16 or retaining region 8, it may be that only one leg includes such a lip 16 the other merely being provided to bias the lip 16 once installed with the printed circuit board in a direction to maintain engagement.

It can be seen from FIG. 3 for example that the latching means include a sloping surface to the direction C which will aid in the insertion of the latching means through the opening 14 of the printed circuit board. In this manner a snap fit engagement can be achieved.

At alternative configuration the pair of legs of the latching means may be biased in act opposite direction and presents an L shape lip configuration which face towards each other rather than away from each other as shown in FIG. 3. In such a configuration the printed circuit board may be provided with two openings and through which each of the legs can extend and pass through to then move towards each other for active engagement with the upper facing surface of the printed circuit board.

The aperture or opening 14 of the printed circuit board may be of any suitable shape to allow for part of the legs to extend through and subsequently provide clamping engagement to the printed circuit board with the housing.

Figure 7:
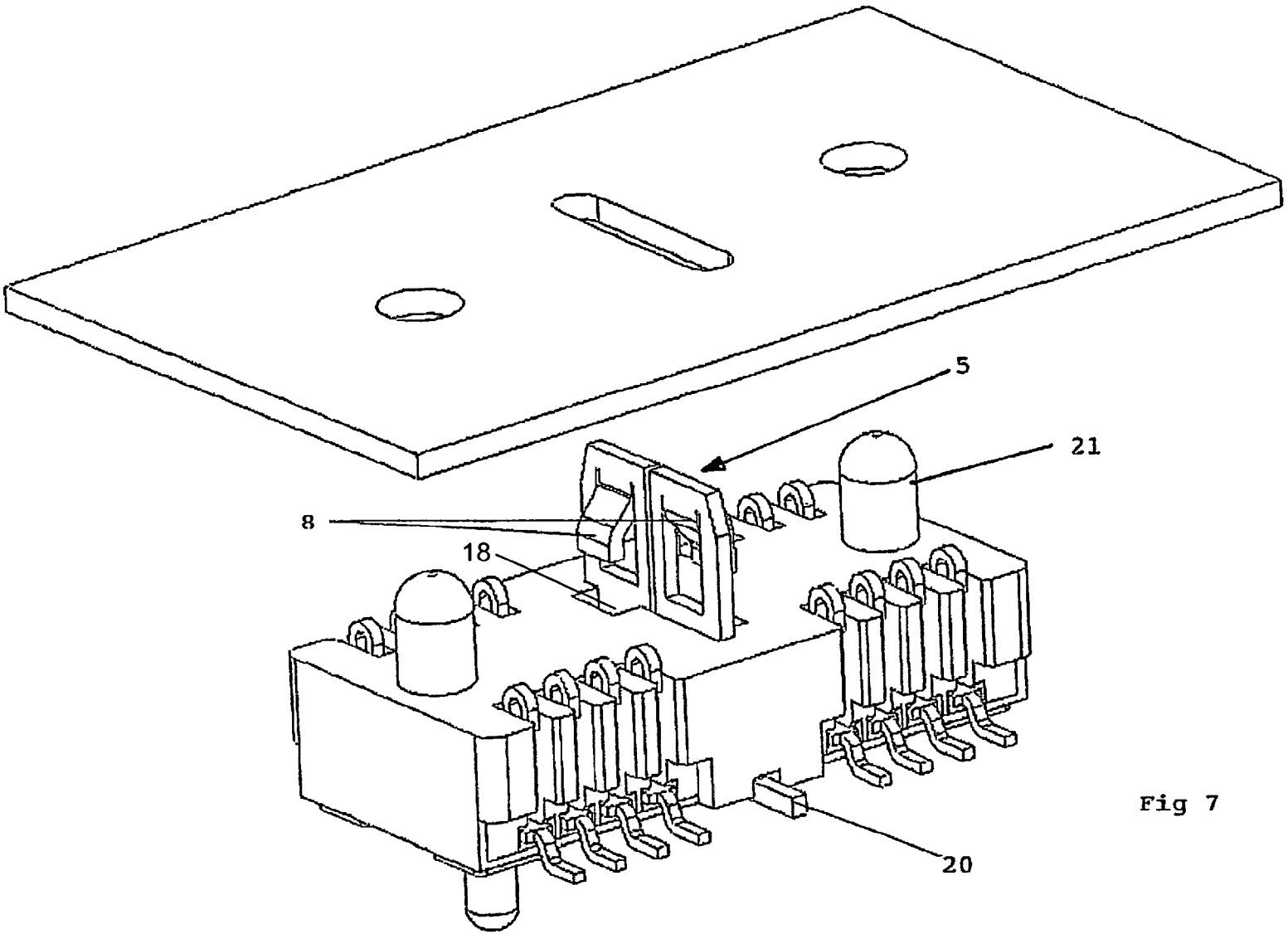
FIG. 7 is a perspective view of an alternative configuration of latching means.
Figure 12:
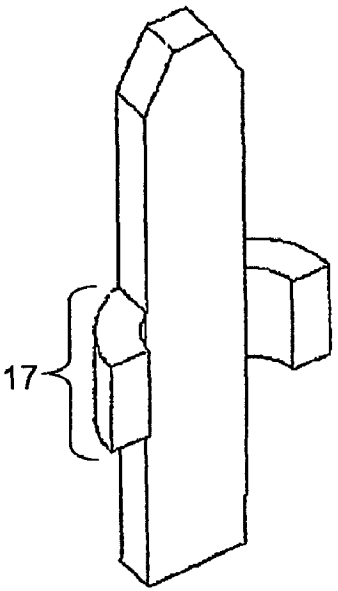
FIGS. 8-12 are perspective views of retention means of a form which are press-fittable with a first electrical device.
Figure 11:
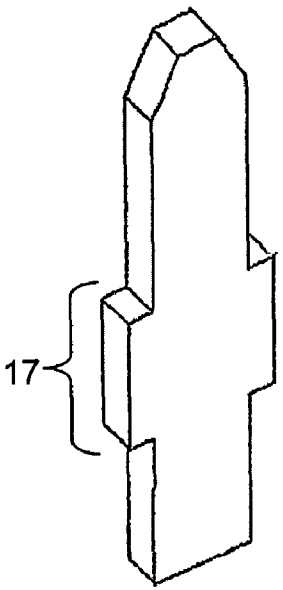
Figure 10:
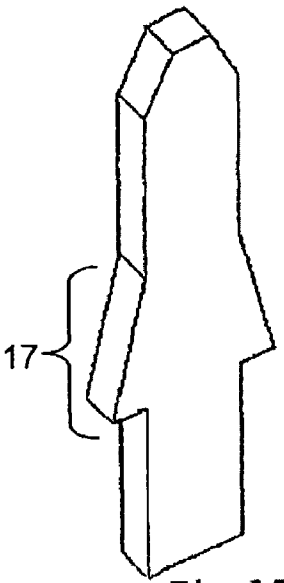
Figure 9:
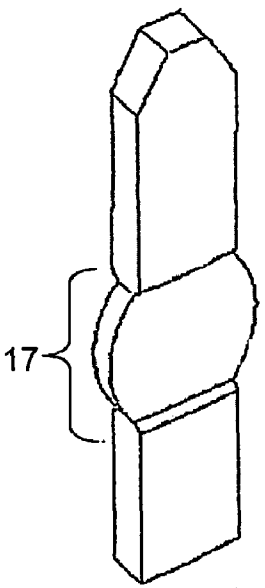
Figure 8:
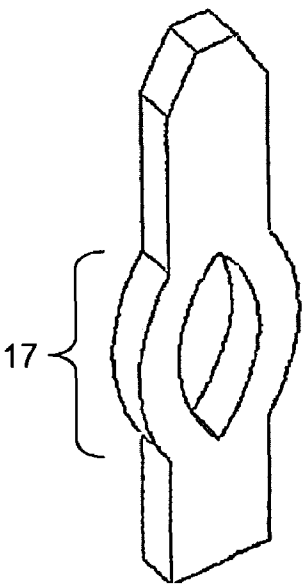

With refence to FIG. 7 there is shown an altrenative configuration of latching means 5 wherein two legs extend from said housing. The legs are joined at a lower region (eg located within said housing ) 18 but are split from each above said housing so that they can move relative to each other. The legs each have a latching region 8 with a downwardly facing surface which is to engage with an upwardly facing surface of the circuit board. The latching regions are formed by being displaced from the plane of the legs. The latching regions may be resiliently deflectable relative to the main upstand sections of the legs. The latching regions may themselves be the only portion of the legs which deflect relative to the housing upon insertation through the aperture of the circuit board. indeed that split as mentioned above need not be provided if the latching regions are sufficiently deflectable on their own relative to the remainder of the legs.

As can be seen from FIG. 7, the latching means may also include a tab or leg which extends to engage with the second electrical device. Such a tab 20 can locate onto a surface of the second electrical device and thereby provide extra hold down.

The latching means may also serve subsidiary purpose which it to provide shielding. In high density applications it is often a problem that interference from one circuit of the electrical device will interfere with other. A shielding can be proved by the use of a grounded conductor. The latching means in the form where it is made from a sheet metal, can be positioned with said housing in a location where it is able to provide effective shielding where needed. For example in our Singapore patent application SG 200108115-7 there is shown the use of a sheet metal which extends longitudinally between two arrays of conductive element. The sheet metal is of a span which covers an area between the two arrays sufficient to shield an) interference that may occur. The connector (preferably of the compression connection kind) has an array of a plurality of conductive elements on each side of the housing. The housing may have a slot therein within which the sheet metal shield/latching means can be provided. The sheet metal is provided to extend intermediate of the two arrays in the longitudinal direction. The sheet metal may in an alternative form extend in a direction lateral to the longitudinal direction as shown in FIG. 7. The patent specification of SG 200108115-7 is herewith incorporated by way of reference.

With reference to FIGS. 8 to 12 press fit latching means are shown which in use will hold the housing with the first electrical device in a different manner than the snap fit manner of the latching means of FIGS. 1 to 7. The press fit latching means consists of at least one leg which includes a section 17 which is of an increased width. The increase in width (transverse to the direction of engagement) serves to provide retention of the housing with the first electrical device. The leg is able to be inserted into an aperture of the electrical device which will result in an interference fit with the section 17 of increased diameter of the leg. The walls of the aperture will become deformed as the section 17 of increased diameter is inserted therewith. The section 17 of increased width may be pressed to extend all the way through the aperture to then in part locate with the upper facing surface of the device or may remain engaged inside the aperture with the side walls of the aperture. A barbed feature of the section 17 of increased width will in this form of the invention assist in the retention strength. Deformation of the section 17 of increase width may also occur upon insertion. Whilst this is an alternative form of latching, it is less desirable in situations where re-assembly is required since the latch will distort the material of the increased width section 17 and/or the first electrical device.

In general the latching means requires small space for installation in comparison to a threaded insert. The latching means may be made of a sheet metal material and may be stamped and subsequently folded to the appropriate configuration. The latching means may be inserted into a cavity of the housing and may become engaged thereto at least in a direction to prevent is from being pulled out of the cavity towards the printed circuit board. Barbed retaining features may be used for such purposes although other configurations will be obvious to a person skilled in the art. When inserted with the cavity the latching means will present the latching regions appropriately from the housing for engagement with the printed circuit board. With the absence of a threaded connector and designated insert, the connector size can be reduced and the space occupied on a printed circuit board and flex can accordingly be reduced. The connector with latch is not subject to any torque during and after assembly with the electrical devices. Also the cost of incorporating a latch with a housing of a connector will be cheaper than in comparison with a threaded insert even where the latch is made from stamping a sheet material. That portion of the latch which has extended through the printed circuit board may subsequent to initial assembly also be soldered onto the printed circuit board so as to provide additional hold dozen and to function as a stress relief for solder tails.

The invention claimed is:

1. An electrical connector to interpose between opposing surfaces of a first electrical device having a plurality of conductive pads and a second electrical device having a plurality of conductive pads to electrically connect each pad on the surface of said first electrical device with a respective pad on the surface of said second electrical device, the electrical connector comprising;

a housing carrying a plurality of conductive elements, each conductive element including a fiist contact region for engagement with a conductive pad of the surface of said first electrical device and a second contact region for engagement with a conductive pad of the surface of said second electrical device, said conductive elements carried by said housing to present at least said first contact region for compressive engagement with the surface of said first electrical device, said housing presenting a single latching means to engage with said first electrical device to retain said first electrical device with said housing in a direction which extends parallel to the direction of compressive engagement to thereby hold said plurality of conductive pads of said first electrical device in physical contact with respective said first contact regions of said conductive elements, wherein the single latching means extends from only a center portion of said housing.

2. An electrical connector as claimed in claim 1 wherein said latching means is a snap fit latching means.

3. An electrical connector as claimed in claim 1 wherein said latching means is resiliently deflectable expansion snap fit latching means.

4. An electrical connector as claimed in claim 1 wherein said latching means includes at least one pair of latching regions provided by at least one leg projecting from said housing, at least one of the latching regions including an edge or surface the normal to which extends in a direction parallel to the direction of compressive engagement, the edge or surface engagable to a complementary edge or surface of said first electrical device the normal to which extends in a direction opposite to said first mentioned normal to thereby retain said first electrical device with said housing, wherein each latching region is deflectable towards each other in a resilient manner and along a path which extends in a direction lateral to the direction of compressive engagement and thereby allows a snap-fit engagement with said first electrical device to occur.

5. An electrical connector as claimed in claim 1 wherein said latching means includes at least one pair of latching regions provided by at least one leg projecting from said housing, at least one of the latching regions including an edge or surface the normal to which extends in a direction parallel to the direction of compressive engagement, the edge or surface engagable to a complementary edge or surface of said first electrical device the normal to which extends in a direction opposite to said first mentioned normal to thereby retain said first electrical device with said housing wherein each latching region is deflectable away from each other in a resilient manner and along a path which extends in a direction lateral to the direction of compressive engagement and thereby allows a snap-fit engagement with said first electrical device to occur.

6. An electrical connector as claimed in claim 4 wherein said latching regions are provided in the form of a lip of said at least one leg.

7. An electrical connector as claimed in claim 4 wherein the latching regions are provided by a respective said leg.

8. An electrical connector as claimed in claim 4 wherein at least one pair of legs are provided, each leg including one of the latching regions.

9. An electrical connector as claimed in claim 8, wherein each leg of said pair is resiliently biased towards a condition wherein said pair of legs are mutually cooperative to encourage said edge or surface of each latching region to remain in contact with a respective complementary edge or surface of said first electrical device.

10. An electrical connector as claimed in claim 6 wherein said lip is defined by a profile of said leg.

11. An electrical connector as claimed in claim 3 wherein said first electrical device with which said electrical connector is to engage, is a printed circuit board.

12. An electrical connector as claimed in claim 11 wherein said latching means extends from said housing to pass through an opening in said printed circuit board and wherein said latching means presents a lip to engage with a major surface of said printed circuit board opposite to said first mentioned surface.

13. An electrical connector as claimed in claim 12 wherein said lip is positioned relative to said housing so that when said printed circuit board is held to said housing by said latching means said printed circuit board is pressed against said first contact regions with a force which is within the specifications for desired characteristic of physical contact.

14. An electrical connector as claimed in claim 1 wherein said housing is of a generally elongate body which includes an upper surface and an opposite facing lower surface both substantially parallel to the elongate direction of said body and wherein said latching means extends from said housing at the upper surface.

15. An electrical assembly including an electrical connector interposing between opposing surfaces of a first electrical device having a plurality of conductive pads and a second electrical device having a plurality of conductive pads, electrically connecting each pad on the surface of said first electrical device with a respective pad on the surface of said second electrical device, wherein the electrical connector comprises;

a housing carrying a plurality of conductive elements, each conductive element including a first contact region engaged with a conductive pad of the surface of said first electrical device and a second contact region engaged with a conductive pad of the surface of said second electrical device, said conductive elements carried by said housing to present at least said first contact region in a compressive engagement with the surface of said first electrical device, said housing presenting a latching means engaged with said first electrical device to retain said first electrical device with said housing at least in a direction which extends parallel to the direction of compressive engagement to thereby hold said plurality of conductive pads of said first electrical device in physical contact with respective said first contact regions of said conductive elements, wherein the latching means extends from only a center portion of said housing.

16. An electrical assembly as claimed in claim 15 wherein said latching means is a snap fit latching means.

17. An electrical assembly as claimed in claim 15 wherein said latching means is resiliently deflectable expansion snap fit latching means.

18. An electrical assembly as claimed in claim 15 wherein said latching means includes at least one pair of latching regions provided by at least one leg projecting from said housing, at least one of the latching regions including an edge or surface the normal to which extends in a direction parallel to the direction of compressive engagement, the edge or surface engaged to a complementary edge or surface of said first electrical device the normal to which extends in a direction opposite to said first mentioned normal to thereby retain said first electrical device with said housing, wherein each latching region is deflectable towards each other in a resilient manner and along a path which extends in a direction lateral to the direction of compressive engagement and thereby allows a snap-fit engagement with said first electrical device to occur.

19. An electrical assembly as claimed in claim 15 wherein said latching means includes at least one pair of latching regions provided by at least one leg projecting from said housing; at least one of the latching regions including an edge or surface the normal to which extends in a direction parallel to the direction of compressive engagement, the edge or surface engaged to a complementary edge or surface of said first electrical device the normal to which extends in a direction opposite to said first mentioned normal to thereby retain said first electrical device with said housing wherein each latching region is deflectable away from each other in a resilient manner and along a path which extends in a direction lateral to the direction of compressive engagement and thereby allows a snap-fit engagement with said first electrical device to occur.

20. An electrical assembly as claimed in claim 18 wherein said latching regions are provided in the form of a lip of said at least one leg.

21. An electrical assembly as claimed in claim 18 wherein a latching region is provided by a respective one of said legs.

22. An electrical assembly as claimed in claim 18 wherein at least one pair of legs are provided, each leg including one of the latching regions.

23. An electrical assembly as claimed in claim 22 wherein each leg of said pair is resiliently biased towards a condition wherein said pair of legs are mutually cooperative to encourage said edge or surface of each latching region to remain in contact with a respective complementary edge or surface of said first electrical device.

24. An electrical assembly as claimed in claim 20 wherein said lip is defined by a profile of said leg.

25. An electrical assembly as claimed in claim 15 wherein said first electrical device with which said electrical connector is engaged, is a printed circuit board.

26. An electrical assembly as claimed in claim 25 wherein said latching means extends from said housing and passes through an opening in said printed circuit board and wherein said latching means presents a lip to engage with the major surface of said printed circuit board opposite to said first mentioned surface.

27. An electrical assembly as claimed in claim 26 wherein, said lip is positioned relative to said housing so that when said printed circuit board is held to said housing by said latching, means said printed circuit board is pressed against said first contact regions with a force which is within the specifications for desired characteristic of physical contact.

28. An electrical assembly as claimed in claim 15 wherein said housing is of a generally elongate body which includes an upper surface and an opposite facing lower surface both substantially parallel to the elongate direction of said body and wherein said latching means extends from said housing at the upper surface.

29. A connector as claimed in claim 1 wherein the latching means comprises of a leg upstanding from the housing in a direction parallel to the direction of said compressive engagement and having a section therealong which is of an increased width in a direction lateral to said compressive engagement direction which is to engage with an aperture of said first electrical device in an interference fit engagement manner.

30. A connector as claimed in claim 29 wherein said section is deformable relative to said leg.

31. A connector as claimed in claim 29 wherein said section includes a barbed edge which is to pressed into a surface of said first electrical device at said aperture.

32. An electrical assembly as claimed in claim 15 wherein the latching means comprises of a leg upstanding from the housing in a direction parallel to the direction of said compressive engagement and having a section therealong which is of an increased width in a direction lateral to said compressive engagement direction which is engaged at an aperture of said first electrical device in an interference fit engagement manner.

33. An electrical assembly as claimed in claim 32 wherein said section is deformable relative to said leg.

34. An electrical assembly as claimed in claim 32 wherein said section includes a barbed edge which is pressed into a surface of said first electrical device at said aperture.

35. An electrical assembly as claimed in claim 32 wherein said section is at a distance along said leg such that it securely engages said first electrical device and simultaneously holds said surface thereof in compressive engagement with the first contact regions of said conductive elements.

36. An electrical connector as claimed in claim 1 wherein said latching means is of a sheet metal material and includes a housing located region which is engaged to the housing within a cavity thereof.

37. An electrical connector as claimed in claim 36 wherein said housing holds two arrays of conductive elements each array extending in a longitudinal direction and disposed along respective sides of said housing, said cavity of said housing retaining said housing located region of latching means extending in a longitudinal direction and intermediate of said two arrays.

* * * * *